US006617090B2

(12) United States Patent
Pickering et al.

(10) Patent No.: US 6,617,090 B2
(45) Date of Patent: Sep. 9, 2003

(54) TONER FUSING SYSTEM AND PROCESS FOR ELECTROSTATOGRAPHIC REPRODUCTION

(75) Inventors: Jerry A. Pickering, Hilton, NY (US); Borden H. Mills, III, Webster, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/879,585

(22) Filed: Jun. 12, 2001

(65) Prior Publication Data

US 2002/0197553 A1 Dec. 26, 2002

(51) Int. Cl.[7] ..... G03G 13/20; G03G 15/10

(52) U.S. Cl. ..... 430/124; 399/330; 399/331; 399/333; 399/338

(58) Field of Search ..... 430/124; 399/330, 399/331, 333, 338

(56) References Cited

U.S. PATENT DOCUMENTS

| | | | |
|---|---|---|---|
| 3,452,181 | A | 6/1969 | Stryjewski |
| 3,498,596 | A | 3/1970 | Moser |
| 3,912,901 | A | 10/1975 | Strella et al. |
| 3,967,042 | A | 6/1976 | Laskin et al. |
| 4,011,362 | A | 3/1977 | Stewart |
| 4,029,827 | A | 6/1977 | Imperial et al. |
| 4,046,795 | A | 9/1977 | Martin |
| 4,064,313 | A | 12/1977 | Takiguchi et al. |
| 4,071,735 | A | 1/1978 | Moser |
| 4,101,686 | A | 7/1978 | Strella et al. |
| 4,185,140 | A | 1/1980 | Strella et al. |
| 4,199,626 | A | 4/1980 | Stryjewski et al. |
| 4,257,699 | A | 3/1981 | Lentz |
| 4,264,181 | A | 4/1981 | Lentz et al. |
| 4,272,179 | A | 6/1981 | Seanor |
| 4,372,246 | A | 2/1983 | Azar et al. |
| 4,515,884 | A | 5/1985 | Field et al. |
| 4,853,737 | A | 8/1989 | Hartley et al. |
| 4,905,050 | A | 2/1990 | Derimiggio et al. |
| 4,984,027 | A | 1/1991 | Derimiggio et al. |
| 5,017,432 | A | 5/1991 | Eddy et al. |
| 5,157,445 | A | 10/1992 | Shoji et al. |
| 5,217,837 | A | 6/1993 | Henry et al. |
| 5,247,336 | A | 9/1993 | Mills, III |
| 5,332,641 | A | 7/1994 | Finn et al. |
| 5,464,698 | A | 11/1995 | Chen et al. |

(List continued on next page.)

OTHER PUBLICATIONS

"High Temperature Degradation of Silicone Rubber Compounds in a Silicone Oil Environment", by A.W. Henry, Rubber Chemistry and Technology, American Chemical Society, Rubber Division, Akron, OH, vol. 56, pps. 83–92 (1982).

"Cab–O–Sil Untreated Fumed Silica Properties and Functions" Cabot Corp., Tuscola, IL (1978, 1993).

Silicon Compounds: Register and Review, 5th Edition, R.Anderson et al. (Eds.), United Chemical Technologies, Bristol, PA, pp. 59–75 (1991).

"Cab–O–Sil TS–530 Treated Fumed Silica" Cabot Corp, Tuscola, IL (1991; TSD–131, 10/98).

Davis et al., U.S. application No. 09/450,302, filed Nov. 29, 1999.

Pickering et al., U.S. application No. 09/879,466, filed Jun. 12, 2001.

Pickering, U.S. application No., 09/879,674, filed Jun. 12, 2001.

*Primary Examiner*—Mark A. Chapman

(57) ABSTRACT

A toner fusing system for fixing toner to paper. This system includes a fuser member for contacting and heating the toner in the fusing process. The fuser member has a fuser base, a fluoroelastomer fusing surface layer at least 38 microns thick, and a cushion layer between the fuser base and the fusing surface layer. This system utilizes external heating as the primary source of heat energy for the fusing process.

26 Claims, 2 Drawing Sheets

U.S. PATENT DOCUMENTS 5,531,813 A 7/1996 Henry et al.
5,582,917 A 12/1996 Chen et al.
5,595,823 A 1/1997 Chen et al.
5,729,813 A 3/1998 Eddy et al.
5,780,545 A 7/1998 Chen et al.
5,824,416 A 10/1998 Chen et al.
5,851,673 A 12/1998 Chen et al.
5,853,893 A 12/1998 Chen et al.
5,935,712 A 8/1999 Tan et al.
5,998,033 A 12/1999 Tan et al.
6,007,657 A * 12/1999 Eddy et al. ..... 156/184
6,011,946 A 1/2000 Eddy et al.
6,045,961 A 4/2000 Heeks et al.
6,061,545 A * 5/2000 Cerrah ..... 219/216
6,090,491 A 7/2000 Tan et al.
6,096,429 A 8/2000 Chen et al.
6,114,041 A 9/2000 Tan et al.
6,395,444 B1 * 5/2002 Riehle et al. ..... 399/320

* cited by examiner

TONER FUSING SYSTEM AND PROCESS FOR ELECTROSTATOGRAPHIC REPRODUCTION

CROSS-REFERENCE TO CONCURRENTLY FILED APPLICATIONS

Filed concurrently with this application are the application entitled "Toner Fusing System and Process for Electrostatographic Reproduction, Fuser Member for Toner Fusing System and Process, and Composition for Fuser Member Surface Layer", U.S. Ser. No. 09/879,674, and the application entitled "Surface Contacting Member for Toner Fusing System and Process, Composition for Member Surface Layer, and Process for Preparing Composition", U.S. Ser. No. 09/879,466. These two concurrently filed applications are incorporated herein in their entireties, by reference thereto.

BACKGROUND OF THE INVENTION

1. Field of the Invention

The present invention relates to electrostatographic imaging and recording apparatus, and particularly to assemblies in these apparatus for fixing toner to the substrates.

2. Description of Background and Other Information

Generally in electrostatographic reproduction, the original to be copied is rendered in the form of a latent electrostatic image on a photosensitive member. This latent image is made visible by the application of electrically charged toner.

The toner thusly forming the image is transferred to a substrate, such as paper or transparent film, and fixed or fused to the substrate. The fusing of toner to substrate can be effected by applying heat, preferably at a temperature of about 90° C.–200° C.; pressure may be employed in conjunction with the heat.

A system or assembly for providing the requisite heat and pressure customarily includes a fuser member and a support member. The heat energy employed in the fusing process generally is transmitted to toner on the substrate by the fuser member. Specifically, the fuser member is heated; to transfer heat energy to toner situated on a surface of the substrate, the fuser member contacts this toner, and correspondingly also can contact this surface of the substrate itself. The support member contacts an opposing surface of the substrate. Accordingly, the substrate can be situated between the fuser and support members, so that these members can act together on the substrate to provide the requisite pressure in the fusing process.

During the fusing process toner can be offset from the substrate to the fuser member. Toner thusly transferred to the fuser member in turn may be passed on to other members in the electrostatographic apparatus, or to subsequent substrates subjected to fusing.

Toner on the fusing member therefore can interfere with the operation of the electrostatographic apparatus and with the quality of the ultimate product of the electrostatographic process. This offset toner is accordingly regarded as contamination of the fuser member, and preventing or at least minimizing this contamination is a desirable objective.

U.S. Pat. No. 5,217,837 discloses a toner fusing system which utilizes internal heating, and includes a fuser member having a 30–65 micrometer thick fusing surface layer over a 1–3 millimeter thermally conductive HTV silicone elastomer layer. U.S. Pat. Nos. 5,017,432 and 5,332,641 also disclose toner fusing systems characterized by, inter alia, internal heating and fuser members with fluoroelastomer surface fusing layers.

Toner fusing systems using external heating are also known. U.S. Pat. Nos. 4,372,246, 4,905,050, 4,984,027, and 5,247,336 all disclose external heating for the toner fusing function. Of these, the latter three teach a configuration with the fuser roller situated between, and in contact with, two heating rollers.

A factor in achieving sufficient fusing quality is providing sufficient heat transfer from the fusing surface layer of the fuser member to the substrate toner. In the prior art it has been understood that this heat transfer is improved by increasing the thermal conductivity of the fusing surface layer of the fuser member, and it has also been understood that the thermal conductivity of this layer is increased by increasing its content of heat conducting filler. Yet additionally in the prior art, it has been understood that providing the fusing surface layer with particular minimum amounts of the filler is necessary to obtain sufficient thermal conductivity, sufficient heat transfer, and sufficient fusing quality.

However, heat conducting filler particles in the fusing surface layer provide high energy sites for removing toner from the substrate. Therefore, increasing the amount of heat conducting filler content in the fusing surface layer, by providing more reactive sites for the toner, increases toner offset and therefore also increases contamination of the fuser member.

SUMMARY OF THE INVENTION

It has not been known or suggested in the prior art, but with the toner fusing system of the present invention, it has been discovered that fusing quality is maintained even where the quantity of heat conducting filler in the fusing surface layer is reduced, or in fact this filler is absent. Accordingly, the system of the present invention has the advantage of allowing for reducing the heat conductive filler content of the fusing surface layer, thereby lessening toner contamination, while still providing effective fusing of toner to substrate.

It has further been discovered that in a toner fusing system which utilizes external heating as its primary heat source, and which also utilizes a fuser member with one or more cushion layers and a fluoroelastomer fusing surface layer, the thickness of the fluoroelastomer fusing surface layer is critical to operation of the system. Specifically, this feature has been found to be critical to minimizing contamination of this layer, and also to providing it with sufficient strength, wearability, and resistance to delamination.

In this regard, it has surprisingly been discovered that keeping the fluoroelastomer fusing surface layer within a particular maximum thickness significantly lessens the indicated contamination during operation of the system. It has yet additionally been discovered, as a matter of particular surprise, that this lessening of contamination is not affected by the thermal conductivity of the layer as a whole, by the amount of heat conducting particles therein, by the identity of these particles, or by the degree of thermal conductivity characterizing the particular type of heat conducting particles employed. Still further, it has surprisingly been discovered that keeping this layer at or above a particular minimum thickness provides this surface fusing layer with sufficient strength and wearability, and especially resistance to delamination.

The assembly, or system, of the invention includes a fuser member. The fuser member comprises a fuser base as well as at least one cushion layer and a fusing surface layer. The at least one cushion layer and the fusing surface layer successively overlay or reside on the fuser base, with the at least one cushion layer being interposed between the fuser base and the fusing surface layer.

The fusing surface layer serves to contact toner on the substrate, and can further contact the substrate surface on which the toner resides. The fusing surface layer comprises at least one polyfluorocarbon elastomer, or fluoroelastomer, and has a thickness of from 38 microns, or 1.5 thousandths of an inch, to 178 microns, or 7 thousandths of an inch.

The invention also includes one or more external heating members, and optionally yet additionally includes one or more internal heating members. The heating member or members are for heating the fuser base and the layers residing thereon, or at least for heating the fusing surface layer. The heated fusing surface layer in turn heats the toner, thereby providing the necessary heat energy for the fusing process.

The at least one external heating member is the primary heat source for the toner fusing system of the invention. Where at least one internal heating member is also present, it acts as a secondary heat source for the toner fusing system of the invention.

The invention preferably also comprises a support member for cooperating with the fuser member. Specifically, with a substrate located between the fuser member and support member, they cooperate to exert pressure on the substrate during the fusing process; the fuser and support members define a nip that the substrate passes through, thereby providing appropriate pressure for the fusing process.

DESCRIPTION OF THE INVENTION

The fuser member is understood as including the fuser base as well as the cushion and fusing surface layers.

As used herein with reference to heating members, the terms "external" and "internal" pertain to positioning with respect to the fuser base. In this regard, "external" indicates location outside of the fuser base, and "internal" means residence within the fuser base.

Correspondingly, an external heating member is outside the fuser member, and therefore outside the fuser base. It thusly provides heat to the fusing surface layer from outside the fuser member.

Consistent with the foregoing, an internal heating member is inside the fuser base, and correspondingly inside the fuser member. It accordingly provides heat to the fusing surface layer from within the fuser member.

Further as to the matter of heating, the term "primary" refers to providing more than 50%, and up to and including 100%, of the heat energy employed for fusing toner to the substrate on which it resides. External heating serves as the sole or at least—as indicated—primary source for this heat energy. Correspondingly, the term "secondary" refers to providing less than 50% of the heat energy. If used, internal heating serves—also as indicated—only as a secondary source for the toner fusing heat energy.

Copolymers are understood as including polymers incorporating two monomeric units, as well as polymers incorporating three or more different monomeric units, e.g., terpolymers, tetrapolymers, etc.

Polyorganosiloxanes are understood as including polydiorganosiloxanes—i.e., having two organo groups attached to each, or substantially each, or essentially each, of the polymer siloxy repeat units. Polyorganosiloxanes are further understood as including polydimethylsiloxanes.

The term "organo" as used herein, such as in the context of polyorganosiloxanes, includes "hydrocarbyl", which includes "aliphatic", "cycloaliphatic", and "aromatic". The hydrocarbyl groups are understood as including the alkyl, alkenyl, alkynl, cycloalkyl, aryl, aralkyl, and alkaryl groups. Further, "hydrocarbyl" is understood as including both non-substituted hydrocarbyl groups, and substituted hydrocarbyl groups, with the latter referring to the hydrocarbyl portion bearing additional substituents, besides the carbon and hydrogen. Preferred organo groups for the polyorganosiloxanes are the alkyl, aryl, and aralkyl groups. Particularly preferred alkyl, aryl, and aralkyl groups are the $C_1$–$C_{18}$ alkyl, aryl, and aralkyl groups, particularly the methyl and phenyl groups.

Figure 2:
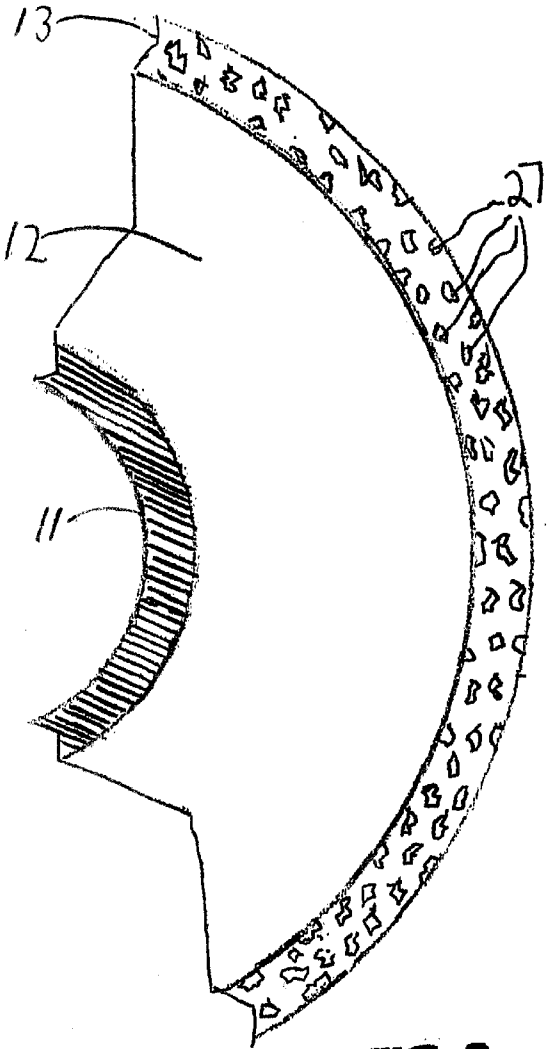
FIG. 2 is a schematic representation, and an enlarged fragmentary sectional view, of an embodiment of the fuser member of the invention.

The different types of fillers incorporated in the cushion and fusing surface layers of the invention may be in one or more of any suitable shapes—irregular, as shown in FIG. 2, as well as in the form of spheroids, platelets, flakes, powders, ovoids, needles, fibers, and the like. In the case of heat conducting fillers, an irregular shape is more preferred, as are spherical particles and platelets. However, fibers, needles, and otherwise elongated shapes are less preferred, unless they are advantageously oriented, because in certain alignments they are less effective for properly conducting heat.

In this regard, elongated heat conducting particles are more efficient for conducting heat in the proper direction if they are at right angles to the fuser base—radially aligned, if the fuser base is a cylindrical core, belt on rollers, or a core-mounted plate, but less efficient if they are positioned parallel to the core—axially aligned, if the fuser base is a core, a belt, or is core mounted as indicated. Accordingly, if elongated heat conducting particles are employed, perpendicular (radial) positioning is preferred, while parallel (axial) alignment may be employed but is not preferred.

Fillers used in the present invention preferably have a mean particle diameter of about 0.1 microns to about 80 microns, more preferably about 0.2 microns to about 20 microns.

The fuser base may be a core in the form of a cylinder or a cylindrical roller, particularly a hollow cylindrical roller. In this embodiment the fuser base may be made of any suitable metal, such as aluminum, anodized aluminum, steel, nickel, copper, and the like. Also appropriate are ceramic materials and polymeric materials, such as rigid thermoplastics, and thermoset resins with or without fiber enforcement. Preferably the roller is an aluminum tube or a flame sprayed aluminum coated steel tube.

Alternatively, the fuser base may be a plate. Materials suitable for the core may also be used for the plate.

One embodiment of a fuser base in the plate form is a curved plate mounted on a larger cylindrical roller—that is, larger than a cylindrical roller which itself is employed as a fuser core. Being thusly curved, the plate accordingly has the shape of a portion of a cylinder. Additionally, the plate can be removably mounted on the cylindrical roller, so that the plate can be replaced without also requiring replacement of the roller. In this embodiment, the properties discussed herein with reference to the fuser base pertain only to the portion of the cylindrical roller occupied by the attached plate; the rest of this roller is not involved in the fusing of toner to substrate.

As yet another alternative, the fuser base may be a belt, particularly an endless flexible belt. A thin belt made of a suitable metal, such as those indicated for the core and plate forms; the belt may also be made of a polyamide, particularly a heat resistant polyamide. A material appropriate for the belt is commercially available under the trademark Kapton, from DuPont High Performance Films, Circleville, Ohio.

Preferably the belt is mounted on rollers, which can be cores of the type as discussed herein. As a matter of preference two rollers are utilized with the belt, each of these two rollers defining a different one of the curves around which the belt passes.

A support member for the invention can be a backup roller, also referred to as a pressure roller, a plate, or a belt. Cores suitable for the fuser member may also be used for the backup roller. Materials indicated as being appropriate for the fuser core, plate, and belt may also be used for the support roller, plate, and belt.

In any of the indicated forms, the support member may have mounted thereon a cushion for forming the nip with the fuser member. Suitable cushion materials include those having at least some degree of temperature resistance, such as silicone and EPDM elastomers. In the absence of yet a further layer in turn being mounted on the cushion, this cushion also serves to contact the substrate, and accordingly to cooperate with the fuser member.

Alternatively or in addition to the cushion, the support member may have mounted thereon a thin fluoroplastic surface layer, such as a Teflon or PFA layer, overlaying the surface that cooperates with the fuser member. Where both the cushion and the thin fluoroplastic surface layer are present on the support member, the cushion is situated between the support member and the surface layer.

External heating members for the present invention include contact heating members—i.e., external heating members that contact the fuser member in transferring heat thereto—and noncontact heating members. Contact heating members are preferred.

Particularly preferred contact heating members are cylindrical rollers having disposed therein a suitable heat energy generator, such as a heating wire or a heating lamp. Heating lamps that may be used for this purpose include tungsten filament lamps and halogen quartz lamps. The cylindrical rollers themselves are made of a hard, noncompliant material with high thermal conductivity; one or more suitable metals, such as steel and aluminum, may be employed. Preferably these rollers are aluminum, with anodized aluminum surfaces. The rollers can include one or more suitable coatings, such as a thermally conductive fluoroplastic or resin.

Eligible noncontact external heating members include radiant, convection, microwave, and induction heat sources. The type of heat energy generators which are appropriate for disposition within contact heating members likewise are suitable for use as noncontact external heating members. Where a noncontact external heating member comprises a heating wire or a heating lamp, it is situated in sufficient proximity to the fuser member so as to heat the fuser member to the requisite degree.

Internal heating members for the present invention include heat energy generators appropriate for location inside the fuser base. Examples are the indicated heating wires and lamps—i.e., those stated to be suitable for use in the contact external heating members, and for use as noncontact external heating members.

Where the fuser base is an endless belt mounted on two rollers in the configuration as discussed herein, there may be a single external heating member situated at one curve of the belt. Alternatively, two external heating members—one at each curve—may be employed.

Where the fuser base is a cylindrical roller, the fuser member correspondingly can be in the form of a roller—specifically, a fuser roller.

In a particularly preferred embodiment of the invention the fuser base comprises a cylindrical roller and the fuser member correspondingly comprises a fuser roller, with the at least one external heating member comprising two contact heating members. Each of the two contact heating members comprises a cylindrical roller having a heat energy generator inside. These two external heating members are spaced apart by a distance that allows the fuser member to be in contact with both simultaneously. Preferably the support member comprises a backup roller, and forms the indicated nip on the opposite side of the fuser member from the heating member configuration.

The contact heating members here can be load bearing—particularly, capable of supporting the load generated by the toner fusing assembly, and more particularly the load that generates the nip between the fuser and support members. With this capability the heating members form a nest for the fuser member; the fuser member is without support, and is situated in this nest.

Alternatively, the fuser and support members can be supported, and pressed together to form the nip. In this instance the contact heating members need not be load supporting, but rather are only required to press against the fuser member to effect the requisite heat transfer.

In this embodiment the support member is above the fuser member, which itself is above the two contact heating members. In the operation of this embodiment of the toner fusing system, the toner-bearing substrate is fed to the fuser member-support member nip with the toner on the bottom side of the substrate, so as to be contacted by the fuser member.

The positioning of the indicated elements of the system may be reversed, so that the contact heating members are above and the support member below the fuser member. Here the toner-bearing substrate is fed to the nip with the toner on the top side of the substrate.

A cushion, comprising at least one cushion layer, overlays the fuser base. The at least one cushion layer can include one or more thermally conductive cushion layers and/or one or more thermally nonconductive cushion layers. Where two or more cushion layers are employed, conductive and nonconductive layers can be arranged alternatively, in either order, and/or two or more conductive layers, and/or two or more nonconductive layers, can be positioned sequentially.

The at least one cushion layer can be free, or substantially or essentially free, of heat conducting filler particles. In this regard, there can be provided one or more cushion layers which are thermally nonconductive by reason of being thusly free, or substantially or essentially free, of heat conducting filler particles, or at least being without a sufficient amount of heat conducting filler particles therein to render the layer thermally conductive.

Where the fuser member has only one cushion layer, this layer can be free, or substantially or essentially free, of heat conducting filler particles. Where there is more than one cushion layer, then one cushion layer, or more than one cushion layer, up to and including all of the cushion layers, can be free, or substantially or essentially free, of heat conducting filler particles.

Further, one or more cushion layers of the invention, particularly those which are thermally conductive, can comprise up to about 45 percent by volume heat conducting filler particles. Compounds suitable as heat conducting filler particles include $SnO_2$, SiC, CuO, ZnO, FeO, $Fe_2O_3$, and $Al_2O_3$. Where heat conductive filler is employed, one or more of these compounds may be used.

Further with respect to heat conductive filler particles, the presence of these in a cushion layer makes the layer harder, i.e., raises the durometer of the layer. Further, the greater the proportion of this filler in the layer, the harder the filled layer is rendered.

Accordingly, the at least one cushion layer can comprise heat conducting filler particles dispersed therein, and can be rendered thermally conductive by the presence of a sufficient amount of this filler. Where the fuser member has only one cushion layer, this layer can comprise heat conducting filler particles dispersed therein, and can be rendered thermally conductive by the presence of a sufficient amount of this filler. Where there is more than one cushion layer, then one cushion layer, or more than one layer, up to and including all of the cushion layers, can comprise heat conducting filler particles dispersed therein, and can be rendered thermally conductive by the presence of a sufficient amount of this filler.

Where there are two or more cushion layers, then one or more cushion layers can be free, or substantially or essentially free, of heat conducting filler particles, while also one or more of these cushion layers can comprise heat conducting filler particles dispersed therein, and can be rendered thermally conductive by the presence of a sufficient amount of this filler.

When internal heating is employed along with the primary external heating, the fuser member should include one or more cushion layers with at least a degree of thermal conductivity. Preferably, there is at least one thermally conductive cushion layer adjacent to and residing on the fuser base, or at least near the fuser base.

In this regard, thermally conductive cushion adjacent to or near the fuser base serves to direct heat from the internal source away from the base, and so help to keep the base or core temperature from becoming excessive. However, when no internal heating is present, then it is preferred that there be no thermally conductive layer adjacent to or even near the fuser base, for the reason that such a configuration would increase the loss of heat through the fuser base.

Certain properties of the at least one cushion layer can be of particular significance, particularly when contact heating is employed. For instance, there must be a sufficient area of contact between fuser member and contact heating member—i.e., a sufficient portion of the surfaces of the fuser and heating members must be touching—to allow for an effective heat transfer. This contact area is provided by one or both of fuser and heating members having sufficient compliance, or deformability, so that the requisite contact area results from these members being in contact. Specifically, as between fuser member and contact heating member, at least one of these compresses or indents enough to provide the requisite surface area of contact.

Where the contact heating source is one or more hard, noncompliant heating members, as discussed, it is the fuser member that has the requisite deformability for achieving the indicated contact area. Moreover, of the elements comprising the fuser member, it is the at least one cushion layer that is sufficiently compliant.

This compliance is determined by a combination of two different features—thickness and durometer. In order to be compliant enough to provide the necessary contact area, the at least one cushion layer comprises one or more layers with a total thickness of at least about 3.3 millimeters, more preferably from about 3.3 millimeters to about 13 millimeters, and each of these one or more layers has a Shore A durometer of about 75 or less—more preferably of about 70 or less, still more preferably of about 65 or less.

Considering the foregoing, the at least one cushion layer can include a layer, or multiple layers, that are not equal to or less than the indicated durometer. For instance, a single cushion layer, or two or more cushion layers, can have an amount of filler, such as heat conducting filler particles, great enough to render a Shore A durometer greater than about 75—or 70, or 65, depending upon what the stated upper limit is. Each cushion layer which, for this or any other reason, is above the designated hardness upper limit is not included in the indicated total thickness. Conversely, however, any cushion layer which incorporates the filler is included in the indicated total thickness, if the layer is at or within the designated hardness upper limit.

This particular total thickness—i.e., the sum obtained by adding together the thickness of each cushion layer at or within the stated upper durometer limit—is referred to herein as "compliance total thickness". Where the compliance total thickness is from about 3.3 millimeters to about 3.8 millimeters, each of the layers included in this thickness preferably has a Shore A durometer of about 65 or less. Here, with the relatively low value for the compliance total thickness, a relatively lower hardness is preferred to obtain the requisite compliance.

As a preferred range, the compliance total thickness is from about 3.8 millimeters to about 13 millimeters, with each cushion layer that makes up this thickness having a Shore A durometer of from about 30 to about 70. Regarding this thickness upper limit, presently it is believed that any additional benefit which may be derived from increasing the thickness, such as obtaining greater compliance, diminishes above about 13 millimeters, and ceases entirely at about 15 millimeters. However, the foregoing observation is provided only for the purposes of discussing the features of the invention as they are currently best understood, and it is not to be considered as a limiting the scope of the invention. Accordingly, compliance total thicknesses of greater than 13 millimeters are also within the scope of the invention.

The at least one cushion layer, as a matter of particular preference, comprises one or more layers with a total thickness of from about 5 millimeters to about 10 millimeters, and each of these one or more layers has a Shore A durometer of about 75 or less—more preferably of about 70 or less, still more preferably of about 65 or less.

In a still more preferred embodiment, the at least one cushion layer comprises one or more layers with a total thickness of from about 5 millimeters to about 10 millimeters, and each of these one or more layers has a Shore A durometer of from about 20 to about 75—yet more preferably from about 30 to about 70, and yet more preferably from about 40 to about 65.

In contrast with the indicated cushion layer thickness ranges for the present invention, fuser member cushions in toner fusing systems which employ only internal heating cannot be thicker than about 3 millimeters. For these systems, thickness is limited by the excessive fuser base temperatures which would be required for cushions of more than about 3 millimeters, and also is limited because such cushions would entail excessive droop—which is the delay in heating response between the surface of the fusing member and the internal heating source due to the thermal resistance of the cushion. However, in the present invention, even where internal heating is employed, it is only secondary to the primary external heating. Accordingly, the greater cushion thickness values of the present invention do not require internal heat source temperatures which would exceed the fuser base limits, nor do they entail excessive droop.

In preparation for application of the at least one cushion layer, the fuser base optionally can first be degreased and surface roughened. If these functions are performed, they may be accomplished by grit blasting. Except as discussed otherwise herein, the fuser base surface, whether or not initially degreased and roughened, is primed with conventional primer, such as Dow™ 1200 RTV Prime Coat primer, from Dow Corning Corporation, Midland, Mich., and material for forming a cushion is subsequently applied thereto.

Materials which may be used for the at least one cushion layer include suitable silicone elastomers, such as appropriate thermally conductive silicone elastomers and thermally nonconductive silicone elastomers. Addition cure, condensation cure, and peroxide cure silicone elastomers can all be used, with addition cure silicone elastomers and condensation cure silicone elastomers being preferred.

Further, silicone elastomers formulated as room temperature vulcanizate (RTV), liquid injection moldable (LIM), and high temperature vulcanizate (HTV) silicone elastomers can be used. RTV and LIM silicones are preferred.

A highly desired property for the silicone elastomers of the invention is heat stability. This property is characterized by low compression set, resistance to hardening or softening over time, and resistance to tear propagation from heat aging.

In particular, compression set is permanent deformation. Low compression set, or good compression set resistance, is required for the desired shape of the fuser roller to be maintained.

To form a cushion layer silicone elastomer is molded, particularly by injection, or extruded or cast onto the fuser base to the desired thickness. Curing is then effected. For a RTV silicone, this is accomplished by allowing it to sit at room temperature.

After curing, conventionally the silicone layer is subjected to a post cure, which improves compression set resistance. Typically a post cure is conducted at a temperature of around 200° C., or about 150–200° C., or about 200–230° C., or as high as about 240° C., for a period of about 1–2 hours, or for about 4 hours, or for about 24 hours, or for a period of about 4–48 hours.

Each silicone cushion layer is subjected to cure, and preferably also to post cure, before application of the next layer, except in the case of the last silicone layer to be laid down. For this finally applied silicone cushion layer, the fluoroelastomer composition is first laid down and then cured at a raised temperature for a period of time, as discussed herein.

This curing of the fluoroelastomer composition serves as the post cure for the silicone cushion layer on which it is deposited. Delaying the post cure of the last cushion layer in this manner allows maximum adhesion between the cushion and the fusing surface layer to develop.

Where only one silicone cushion layer is employed, since it is also the last cushion layer to be laid down, it is not post cured until the fluoroelastomer layer is applied, in accordance with the foregoing.

Before the polyfluorocarbon elastomer or fluoroelastomer composition for forming the fusing surface layer is applied, the cushion material can be ground to a desired profile, depending upon the paper handling concerns to be addressed. For instance, a cylinder shape, or a crown, or barrel, or bow tie, or hourglass profile may be provided.

Addition cure silicone elastomers typically employ a platinum catalyst; condensation cure silicone elastomers, a tin catalyst. Tin catalysts will poison platinum catalysts, but the reverse is not true. Accordingly, where sequential addition and condensation cure silicone elastomer layers are employed, a condensation cure layer can be applied onto an addition cure layer, but not vice versa.

In one particular embodiment of the invention, the fuser member has a single silicone elastomer cushion layer, with a thickness of from about 200 mils (about 5 millimeters) to about 400 mils (about 10 millimeters). This cushion layer does not have heat conducting filler added thereto, and is a thermally nonconductive or low thermal conductivity material; preferably it comprises a silicone commercially available under the designation Silastic™-J from Dow Corning Corporation. In another particular embodiment of the invention, the fuser member has two silicone elastomer cushion layers, one overlying the other, with a total cushion thickness also of from about 200 mils (about 5 millimeters) to about 400 mils (about 10 millimeters). Like the single cushion layer of the immediately preceding embodiment, the underlying layer in this embodiment does not have heat conducting filler added thereto, and is a thermally nonconductive or low thermal conductivity material; it also preferably comprises Silastic J silicone. The overlying layer is a thermally conductive material, preferably highly thermally conductive, and also preferably has a heat conducting filler content of from about 38 to about 45 volume percent; yet further as a matter of preference, this layer comprises a silicone commercially available under the designation EC4952 from Emerson & Cuming ICI, Billerica, Mass. Of the indicated total cushion thickness, the layer underneath is relatively thicker, and the overlying layer is relatively thinner. In this regard, the overlayer has a thickness of from about 15 to about 30 mils (from about 0.38 to about 0.76 millimeters), with the underlayer accounting for the remainder.

Yet additionally suitable for the at least one cushion layer are fluoroelastomers fabricated in the form of foams. Fluoroelastomers suitable for fabrication as foams include those as disclosed herein. Fluoroelastomer foams which may be used include those as disclosed in U.S. Pat. No. 4,372,246.

Fluoroelastomer foam can be applied in the form of a sheet wrapped around the fuser base. Preferably, the fuser base is grit blasted. A suitable adhesive in an appropriate amount is applied to the grit blasted fuser base; Thixon adhesive from Whittaker Corporation may be used. The fluoroelastomer foam sheet is wrapped to the adhesive coated fuser base. Bonding of the foam to the core is completed by curing, which is accomplished by heating at an effective temperature for a sufficient amount of time. Preferably, curing is effected by heating the wrapped core in an oven for two hours at 350° F.

This sheet can be provided in the desired thickness. Alternatively, thickness can be adjusted by grinding after curing.

The fusing surface layer comprises at least one polyfluorocarbon elastomer, or fluoroelastomer. Suitable fluoroelastomers include random polymers comprising two or more monomeric units, with these monomeric units comprising members selected from a group consisting of vinylidene fluoride [—($CH_2CF_2$)—], hexafluoropropylene [—($CF_2CF(CF_3)$)—], tetrafluoroethylene [—($CF_2CF_2$)—], perfluorovinylmethyl ether [—($CF_2CF(OCF_3)$)—], and ethylene [—($CH_2CH_2$)—]. Among the fluoroelastomers that may be used are fluoroelastomer copolymers comprising vinylidene fluoride and hexafluoropropylene, and terpolymers as well as tetra- and higher polymers including vinylidene fluoride, hexafluoropropylene, and tetrafluoroethylene monomeric units. Another suitable monomer is perfluorovinylmethyl ether.

Preferred fluoroelastomers include random polymers comprising the following monomeric units:

$$—(CH_2CF_2)_x—,\ —(CF_2CF(CF_3))_y—,\ \text{and}\ —(CF_2CF_2)_z—,$$

wherein x is from about 30 to about 90 mole percent, y is from about 10 to about 60 mole percent, and z is from about 0 to about 42 mole percent.

Further preferred fluoroelastomers are random polymers comprising the following monomeric units:

$$—(CH_2CH_2)_x—,\ —(CF_2CF(OCF_3))_y—,\ \text{and}\ —(CF_2CF_2)_z—,$$

wherein x is from about 0 to about 70 mole percent, y is from about 10 to about 60 mole percent, and z is from about 30 to about 90 mole percent The fluoroelastomers, as discussed, may further include one or more cure site monomers. Among the suitable cure site monomers are 4-bromoperfluorobutene-1, 1,1-dihydro-4-bromo-perfluorobutene-1, 3-bromoperfluorobutene-1, and 1,1-dihydro-3-bromoperfluoropropene-1. When present, cure site monomers are generally in very small molar proportions. Preferably, the amount of cure site monomer will not exceed about 5 mole percent of the polymer.

The fluoroelastomer molecular weight is largely a matter of convenience, and is not critical to the invention. However, as a matter of preference, the fluoroelastomers have a number average molecular weight of from about 10,000 to about 200,000. More preferably they have a number average molecular weight of from about 50,000 to about 100,000.

Commercially available fluoroelastomers which may be used are those sold under the trademark Viton® by Dupont Dow Elastomers, Stow, Ohio; they include Viton® A, Viton® B, Viton® E, Viton® GF, Viton® GH, Viton® GFLT, Viton® B 50, Viton® B 910, Viton® E 45, Viton® E 60C, and Viton® E 430. Also suitable are the Tecnoflons®, such as T838K and FOR4391 from Ausimont USA, Inc., Thorofare, N.J., and the Fluorel™ fluoroelastomers, such as FE5840Q, FLS5840Q, FX9038, and FX2530 from Dyneon L.L.C., Oakdale, Minn.

Appropriate fluoroelastomers include those as identified in U.S. Pat. Nos. 4,372,246, 5,017,432, 5,217,837, and 5,332,641. These four patents are incorporated herein in their entireties, by reference thereto.

The Viton® A, Viton® GF, FE5840Q, and FX9038 fluoroelastomers are particularly preferred.

Fluoroelastomer preferably comprises from about 30 percent by volume to about 90 percent by volume of fluoroelastomer compositions used to prepare coating preparations of the invention. Fluoroelastomer likewise preferably comprises from about 30 percent by volume to about 90 percent by volume of fusing surface layers of the invention.

For preparation of the fusing surface layer, or fluoroelastomer layer, one or more curing agents or curatives are employed in a suitable amount to effect curing of the fluoroelastomer. Suitable curatives for the fluoroelastomer include nucleophilic addition curing systems. Also appropriate as curatives are free radical initiator curing systems.

Preferred nucleophilic addition curing systems for the fluoroelastomer are the bisphenol curing systems. These preferably include at least one bisphenol crosslinking agent and at least one accelerator.

Suitable bisphenol crosslinking agents include 4,4-(hexafluoroisopropylidene)diphenol, also known as bisphenol AF, and 4,4-isopropylidenediphenol. Accelerators which may be employed include organophosphonium salt accelerators such as benzyl triphenylphosphonium chloride.

The amount of bisphenol crosslinking agent used, and likewise the amount of accelerator used, each is preferably from about 0.5 parts to about 10 parts per 100 parts by weight of the fluoroelastomer. A bisphenol curing system, taken as a whole, is employed in an amount, based on the total weight of crosslinking agent and accelerator, likewise of from about 0.5 parts to about 10 parts per 100 parts by weight of the fluoroelastomer. A commercially available bisphenol curing system which may be used is Viton® Curative No. 50 from Dupont Dow Elastomers, which is a combination of bisphenol AF and one or more quaternary phosphonium salt accelerators; this curative preferably is used in an amount of from about 2 parts to about 8 parts per 100 parts by weight of the fluoroelastomer.

Further nucleophilic addition curing systems are polyfunctional hindered curing systems, particularly diamine curing systems. Among the diamine curing systems that may be employed are diamine carbamate curing systems. Examples of these are hexamethylenediamine carbamate and N,N'-dicinnamylidene-1,6-hexanediamine; these are commercially available as DIAK No. 1 and DIAK No. 3, respectively, from E.I. Du Pont de Nemours, Inc. DIAK No. 4 is another polyfunctional hindered diamine curing system that may be used.

Free radical initiator curing systems which may be used include peroxide free radical initiator curing systems. Preferably these comprise at least one peroxide free radical initiator, and at least one suitable crosslinking agent; peroxides that may be employed for this purpose include the suitable aliphatic peroxides.

Particular peroxides which may be used include ditertiary butyl peroxide, dicumyl peroxide, 2,4-dichlorobenzoyl peroxide, 2,5-dimethyl-2,5-di(t-butyl peroxy)hexane, dibenzoyl peroxide and the like. Particular crosslinking agents suitable for these systems include triallyl cyanurate, triallyl isocyanurate, and others known in the art.

Where the curative comprises a nucleophilic addition curing system or a free radical initiator curing system, one or more cocuratives may also be employed. In this regard, the use of these systems for curing fluoroelastomers can generate hydrogen fluoride.

Accordingly, acid acceptors for neutralizing the hydrogen fluoride are suitable cocuratives. Preferred examples of these acid acceptors are the Lewis bases, particularly inorganic bases such as magnesium oxide, zinc oxide, lead oxide, calcium oxide and calcium hydroxide.

The amount of cocurative which is used preferably is from about 2 parts to about 20 parts per 100 parts by weight of the fluoroelastomer. Particularly where one or more acid acceptors is employed, the amount used is preferably that which is sufficient to neutralize the indicated hydrogen fluoride and allow for complete crosslinking. However, an excessive amount of cocurative, particularly in the case of the more basic curatives such as calcium hydroxide, will shorten the life of the fluoroelastomer solution used to coat the cushion-bearing fuser base, as discussed herein. Specifically, cocurative excess will cause rapid viscosity increase and solution gellation.

Magnesium oxide and zinc oxide are preferred acid acceptors.

One or more types of fillers may be used with the fluoroelastomer for various purposes. Different fillers may be used for such purposes as controlling wear resistance, modifying hardness, or imparting other characteristics to the fluoroelastomer layer. Of particular significance is heat conducting filler, added to affect the thermal conductivity of the fluoroelastomer layer.

For improving the wear resistance, one or more of any fillers which are employed may be utilized or surface treated with a coupling agent as discussed in U.S. Pat. Nos. 5,998,033, 5,935,712, and 6,114,041. These patents are incorporated herein in their entireties, by reference thereto.

As is also the case with other fillers, the fusing surface layer can be free, or substantially or essentially free, of heat conducting filler particles. In this regard, the fusing surface layer can receive and transfer the requisite heat for effecting fusing of toner to substrate, without requiring the presence of the heat conducting filler.

Alternatively, however, the fusing surface layer can comprise heat conducting filler particles dispersed therein. Different compounds utilized as the heat conducting filler particles have differing degrees of thermal conductivity. This filler can be included to accomplish different objectives.

One reason for the presence of heat conducting filler in the fusing surface layer pertains to the external heating member or members, particularly where contact heating is employed. Specifically, the fusing surface layer can incorporate heat conducting filler particles for the purpose of lowering the temperature to which contact heating members must be raised in order to transfer the necessary heat to the fusing surface layer.

The issue here is how hot the contact heating member or members must get so as to apply sufficient heat to the fuser member. The fusing surface layer may have heat conducting filler particles dispersed therein, to lower this temperature requirement. Thus, contact heating members, particularly in the case of cylindrical rollers, can be comprised of materials, especially certain metals, which otherwise would not be suitable because of the temperature to which they would have to be raised in the absence of the heat conducting filler.

Alternatively, it is possible to employ, for the contact heating member or members, metals which would not be adversely affected by the higher temperatures required where heat conducting filler is absent. Where such an appropriate metal or metals is used, it is not necessary to include heat conducting filler in the fusing surface layer for the indicated purpose of lowering the contact heating member temperature requirement.

Apart from this specific reason, however, heat conducting filler particles can serve other functions in the fusing surface layer. For instance, this filler can be included to control material properties of the layer, such as wear resistance and surface roughness, and particularly to obtain certain mechanical properties.

With respect to wear resistance, one or more types of the filler can be incorporated into the fusing surface layer in such amount or amounts as will increase this layer's durability. Moreover, also depending on filler identity and proportion, roughness of the surface can be increased or lessened, as desired, by the presence of the filler.

The fusing surface layer can comprise, dispersed therein, up to about 45 percent by volume, or up to about 40 percent by volume, or from about 10 percent by volume to about 35 percent by volume, heat conducting filler particles. The same compounds suitable as heat conducting filler particles for the at least one cushion layer may also be used for the fusing surface layer.

Other adjuvants and additives also may be used with the fluoroelastomer, as long as they do not affect the integrity thereof, or significantly interfere with an activity intended to occur in the layer, such as the crosslinking of the fluoroelastomer. These further adjuvants and additives, where present, are provided in amounts and proportions as are generally known or as can be determined without undue experimentation by those of ordinary skill in the art. Suitable examples include reinforcing fillers, crosslinking agents, processing aids, accelerators, polymerization initiators, and coloring agents.

The fluoroelastomer and curative, as well as those of the foregoing cocurative, filler, adjuvant, and additive components which are being employed, can be combined by means of a suitable dry compounding method, such as the use of a two roll mill.

Commercially provided fluoroelastomers often come with curatives already incorporated therein. However, it is preferred that the curative not be provided in this manner, but rather be employed as a separate component.

Although curative, as such a separate component, may be dry compounded with the other indicated components, preferably it is not, but rather is subsequently added to the solution which is prepared using the dry compounded materials, as discussed herein. Specifically, the curative may be added directly to the solution prior to coating. Withholding the curative thusly for addition to the final coating solution greatly extends this solution's shelf life.

For forming the requisite layer on the fuser member, the fluoroelastomer composition obtained from dry compounding is subdivided into pieces and added to a sufficient amount of one or more solvents to provide a solution or dispersion. Further components may also be added.

For instance, one or more of the polydiorganosiloxane oligomers, particularly the $\alpha,\omega$ difunctional polydiorganosiloxanes, disclosed in U.S. Pat. No. 4,853,737 may be employed in the amount of about 0.1 to 5 grams per 100 grams of solution; this patent is incorporated herein in its entirety, by reference thereto. Particularly, the fluoroelastomer with pendant polydiorganosiloxane segments disclosed in this patent is suitable as the fluoroelastomer component of the present invention.

Further, one or more of the curable siloxane polymers, particularly the curable polyfunctional poly($C_{1-6}$ alkyl)-siloxane polymers, disclosed in U.S. Pat. No. 5,582,917, may be employed in the amount of 5 parts to about 80 parts per hundred parts by weight of the fluoroelastomer; this patent is incorporated herein in its entirety, by reference thereto. A preferred commercially available curable siloxane polymer is SFR-100 silicone, from GE Silicones, Waterford, N.Y. Particularly, the fluorocarbon copolymer-siloxane polymer composite disclosed in this patent is suitable as the fluoroelastomer component of the present invention.

If both polydiorganosiloxane oligomer and curable siloxane polymer, as discussed, are employed, it is preferable that they be kept separate prior to addition to the fluoroelastomer, because these polydiorganosiloxane oligomers catalyze the crosslinking of the curable siloxane polymers.

Still further, one or more yet additional additives and/or adjuvants can be added to the solution, such as defoaming agents, wetting agents, and other materials. These yet additional adjuvants and fillers, where present, are provided in amounts and proportions as are generally known or as can be determined without undue experimentation by those of ordinary skill in the art.

The amount of solvent used is preferably that which will provide a solution or dispersion having a solids content of from about 10 weight percent to about 50 weight percent, more preferably from about 10 weight percent to about 30 weight percent. Suitable solvents include esters and acetates such as acetone, methyl ethyl ketone (MEK), methyl isobutyl ketone, and mixtures thereof; a preferred solvent comprises 50 weight percent each of methyl ethyl ketone and methyl isobutyl ketone. Other preferred solvents are blends of methyl ethyl ketone and methanol (MeOH), such as blends comprising about 85 percent by weight methyl ethyl ketone and about 15 percent by weight methanol (85:15 MEK:MeOH). Methanol is used to extend the solution life of the coating, or to improve the coating quality.

The solution or dispersion may be applied to the fuser base in a succession of thin coatings, either as discrete layers or as a continuous buildup of layers. Application is by any suitable means, such as dipping, spraying, or transfer coating.

A particularly preferred method of dipping is ring coating. To conduct ring coating, the roller is drawn up through a larger diameter hole machined in two plates, a top plate and a bottom plate. Between the plates is a flexible gasket which forms a liquid tight seal with the roller surface and the top plate. The coating solution is poured into a well created by the roller, the flexible gasket, and the top plate. The roller is drawn up through the gasket and the solution caots the outside of the roller surface. In this manner a minimal amount of solution is used to coat each roller.

After it is applied, each coating is allowed to stand, at room temperature or higher, in order to flash off all or at least most of the solvent. For instance, following each application of a coating layer, evaporation of solvent is effected at temperatures of from about 25° C. to about 90° C. or higher.

When the desired thickness is obtained the resulting layer is cured. Preferably, the layer is heated to a temperature of from about 150° C. to about 250° C. and held for 12 to 48 hours. To prevent bubbling of the layer, either sufficient drying time is allowed for the indicated solvent flash off or evaporation to be completed, or the ramp to cure temperature—i.e., from room temperature to the stated 150° C.–250° C. upper limit—is extended over a period of 2 to 24 hours.

The number of coatings applied to form the fusing surface layer is that which will provide the requisite degree of thickness. The fusing surface layer preferably has a thickness of at least 38 microns. More preferably, the fusing surface layer has a thickness of at least 50 microns.

Insufficient thickness of the fluoroelastomer fusing surface layer results in problems with respect to wearability, and also delamination. Of these two disadvantageous properties, the latter is particularly evident when the layer is not thick enough. Particularly at a thickness of 25 microns or less, after a relatively short period of use pieces of the fusing surface layer quickly fall away; it delaminates rapidly, ending the useful life of the fuser member.

Also as to these matters there are wear mechanisms to take into consideration. These mechanisms are particularly a factor at the edge of the substrate, and especially where the substrate is paper. Paper edges have a propensity for inflicting wear on the fusing surface layer, and the wear mechanisms brought into play by the paper edges will effect delimination, as discussed, where the fusing surface layer is too thin.

Conversely, where the fluoroelastomer fusing layer has a thickness of 178 microns or less, contamination of this layer by toner from the substrate is significantly reduced. More preferably, the fusing surface layer has a thickness 130 microns or less.

The fusing surface layer can have a thickness of from 38 microns to 178 mils. More preferably, the fusing surface layer has a thickness of from 50 microns to 130 microns.

In the operation of the toner fusing system of the present invention, release agent can be applied to the fusing surface layer so that this agent contacts toner on the substrate, and can also contact the substrate, during the operation of the fuser member. Particularly where the fuser base is a cylindrical roller or an endless belt, the release agent is applied, while the base is rotating or the belt is running, upstream of the contact area between fuser member and substrate toner.

If employed, release agent preferably is applied so as to form a film on the fusing surface layer. As a matter of particular preference, release agent is applied so as to form a film that completely, or at least essentially, or at least substantially, covers the fusing surface layer. Also as a matter of preference, during operation of the system the release agent is applied continuously, or at least essentially or at least substantially continuously, to the fusing surface layer.

Release agents are intended to prohibit, or at least lessen, offset of toner from the substrate to the fusing surface layer, and if release agent is employed preferably it acts accordingly. In performing this function, the release agent can form, or participate in the formation of, a barrier or film that releases the toner. Thereby the toner is inhibited in its contacting of, or even prevented from contacting, the actual fusing surface layer, or at least the fluoroelastomer thereof.

The release agent can be a fluid, such as an oil or a liquid, and is preferably an oil. It can be a solid or a liquid at ambient temperature, and a fluid at operating temperatures. Also as a matter of preference, the release agent is a polymeric release agent, and as a matter of particular preference, is a silicone or polyorganosiloxane oil.

Suitable release agents are those disclosed in U.S. Pat. Nos. 5,824,416, and 5,780,545. These two patents are incorporated herein in their entireties, by reference thereto.

Further as to this matter, release agents which may be used include polymeric release agents having functional groups. Appropriate polymeric release agents with functional groups include those which may be found as liquids or solids at room temperature, but are fluid at operating temperatures.

Particular functional group polymeric release agents which may be used include those disclosed in U.S. Pat. Nos. 4,011,362 and 4,046,795; these patents also are incorporated herein in their entireties, by reference thereto. Still further release agents which may be used are the mercapto functional polyorganosiloxanes disclosed in U.S. Pat. No. 4,029,827, and the polymeric release agents having functional groups such as carboxy, hydroxy, epoxy, amino, isocyanate, thioether, and mercapto functional groups, as disclosed in U.S. Pat. Nos. 4,101,686 and 4,185,140; yet additionally these patents are incorporated herein in their entireties, by reference thereto.

The more preferred release agents with functional groups are the mercapto functional polyorganosiloxane release agents and the amino functional polyorganosiloxane release agents. Particularly preferred are the release agents, including mecapto functional polyorganosiloxane release agents, consisting of, consisting essentially of, consisting substantially of, or comprising monomercapto functional polyorganosiloxanes, or polyorganosiloxanes having one mercapto functional group per molecule or polymer chain. Also particularly preferred are release agents, including amino functional polyorganosiloxane release agents, consisting of, consisting essentially of, consisting substantially of, or comprising monoamino functional polyorganosiloxanes, or polyorganosiloxanes having one amino functional group per molecule or polymer chain. In this regard, the release agents disclosed in U.S. Pat. Nos. 5,531,813 and 6,011,946 may be used; these patents are incorporated herein in their entireties, by reference thereto.

Further with regard to the functional agents, one point to consider is that because of their expense usually they are diluted with nonfunctional polyorganosiloxanes, particularly nonfunctional polydimethylsiloxanes. Another point is that for obtaining good release activity with a functional release agent, monofunctionality is preferred, so that the molecule cannot react both with toner and with the fusing surface layer, and thereby serve as a toner/fuser member adhesive. Therefore, the functional agent would ideally consist of entirely, or at least consist essentially, of the monofunctional moiety. However that also is impractical, also because of expense.

Therefore, the functional polyorganosiloxane preferably comprises as great a proportion of the monofunctional moiety as is practically possible. As a matter of particular preference, the functional polyorganosiloxane has a sufficient monofunctional proportion so as not to act as the indicated adhesive.

Accordingly, a preferred release agent composition comprises a blend of nonfunctional polyorganosiloxane, particularly nonfunctional polydimethylsiloxane, with amino functional polyorganosiloxane, and the amino functional polyorganosiloxane comprises monoamino functional polyorganosiloxane. Another preferred release agent composition comprises a blend of nonfunctional polyorganosiloxane, particularly nonfunctional polydimethylsiloxane, with mercapto functional polyorganosiloxane, and the mercapto functional polyorganosiloxane comprises monomercapto functional polyorganosiloxane.

The release agent may be applied to the fuser member by any suitable applicator, including sump and delivery roller, jet sprayer, etc. Those means as disclosed in U.S. Pat. Nos. 5,017,432 and 4,257,699 may be employed; the latter of these two patents is incorporated herein in its entirety, by reference thereto. Preferably the present invention employs a rotating wick oiler or a donor roller oiler.

A rotating wick oiler comprises a storage compartment for the release agent and a wick for extending into this compartment. During operation of the toner fusing system of the invention, the wick is situated so as to be in contact with the stored release agent and also with the fusing surface layer of the fuser member; the wick thusly picks up release agent and transfers it to the fuser member.

A donor roller oiler includes two rollers and a metering blade, which can be a rubber, plastic, or metal blade. One roller meters the oil in conjunction with the blade, and the other transfers the oil to the fuser roller. This type of oiler is common in the art, and is frequently used with fuser members having fluoroelastomer fusing surface layers.

The release agent is applied to the substrate, particularly in the case of paper, preferably at a rate of from about 0.1 to about 20 microliters, more preferably at a rate of about 1.0 to about 8 microliters, per 8+e,fra 1.2+ee " by 11" copy. The applicator accordingly is adjusted to apply the release agent at this rate.

Figure 1:
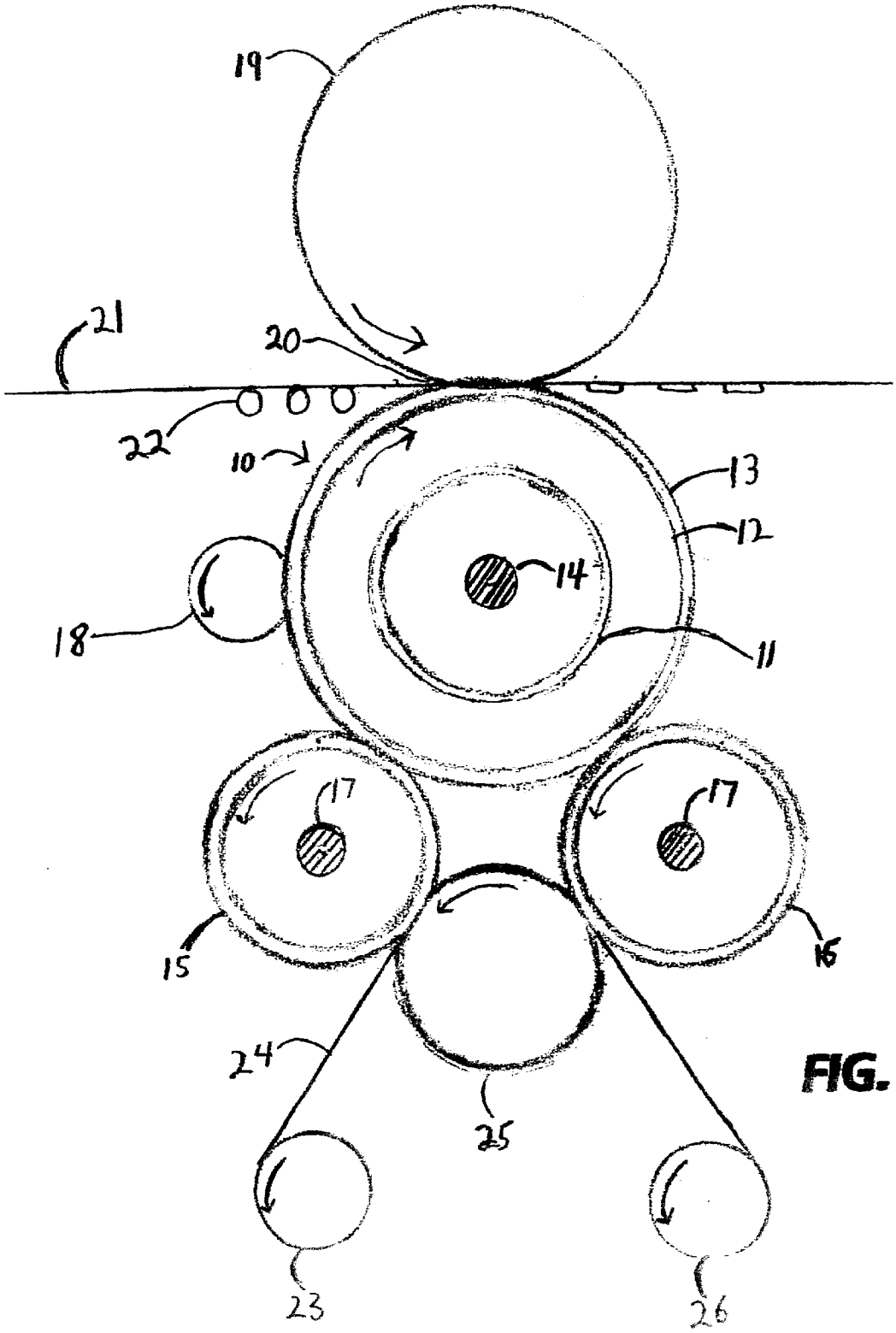
FIG. 1 is a schematic representation, and a sectional view, of a toner fusing assembly of the invention.

A toner fusing system of the invention is shown in FIG. 1. Multilayered fuser roller 10 comprises, in sequential order, a fuser base 11, in the form of a hollow cylindrical roller, as well as a cushion layer 12 and a fusing surface layer 13. Fusing surface layer 13 has heat conducting filler particles (not depicted in FIG. 1) dispersed therein. Internal heating member 14, an optional element in the invention, is disposed in the hollow portion of fuser base 11.

External heating members 15 and 16 are in the form of hollow cylindrical rollers; their rotational directions, and the rotational directions of all the other rotating elements, are shown by their respective arrows. The rotational directions as depicted can all be reversed.

External heating members 15 and 16 are heated by respective heating lamps 17. These two contact heating members are spaced apart by a distance less than the diameter of fuser member 10, which is in contact with both. Contact heating members 15 and 16 transfer heat to fuser member 10 by their contact with fusing surface layer 13.

Rotating wick oiler 18 applies release agent to fusing surface layer 13.

Support member 19, in the form of a backup roller, cooperates with fuser member 10 to form fusing nip or contact arc 20. Copy paper or other substrate 21, carrying unfused toner images 22, passes through fusing nip 20 so that toner images 22 are contacted by fusing surface layer 13. Support member 19 and fuser member 10 act together to apply pressure to the paper 21 and toner 22, and fuser member 10 also provides heat, with the heat and pressure serving to fuse toner 22 to the paper 21.

Dispensing roller 26 incrementally feeds cleaning web 24 over advance roller 25, to be rolled up onto collecting roller 23. In passing along roller 25, web 24 contacts and cleans contact heating members 15 and 16.

Cleaning web 24 is a polyamide material. A polyamide web which may be employed for this purpose is commercially available under the trademark Nomex® from BMP of America, Medina, N.Y. Any other suitable cleaning material may be employed instead.

In place of the indicated cleaning assembly, any other means or apparatus appropriate for cleaning the contact heating members may be employed. Alternatively, the contact heating members can be provided with a nonstick coating. This coating can be a fluoroplastic, as discussed herein, and it can include a heat conducting filler, also as discussed herein. Where the contact heating embers have a nonstick coating the means for cleaning these members can be omitted.

FIG. 2 shows a fragmentary view of an embodiment of fuser member 10, magnified to show the multiple layers in greater detail. Heat conducting filler particles 27 are distributed through fusing surface layer 13.

Figure 3:
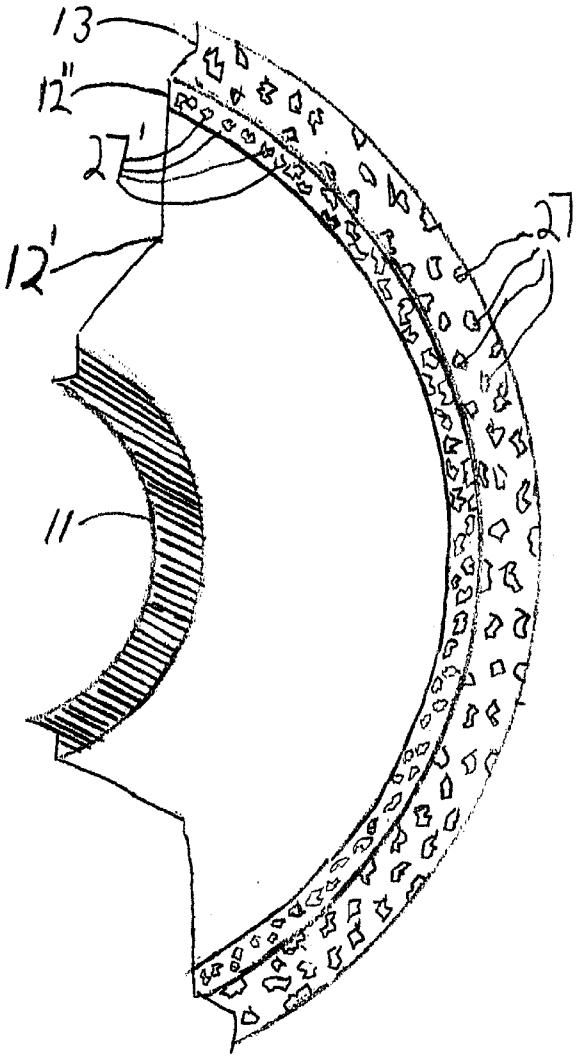
FIG. 3 is a schematic representation, and an enlarged fragmentary sectional view, of another embodiment of the fuser member of the invention.

FIG. 3 shows a fragmentary view of another embodiment of fuser member 10, also magnified to show the multiple layers in greater detail. This embodiment includes two cushion layers, thermally nonconductive layer 12' and thermally conductive layer 12". Thermally conductive layer 12" has heat conducting filler particles 27' distributed therethrough.

The invention is illustrated by the following procedures; these are provided for the purpose of representation, and are not to be construed as limiting the scope of the invention. Unless stated otherwise, all percentages, parts, etc. are by weight.

EXPERIMENTAL PROCEDURES

Materials Employed in the Procedures

Fluorel™ FE5840Q fluoroelastomer, terpolymer of vinylidene fluoride, hexafluoropropylene, and tetrafluoroethylene, from Dyneon L.L.C.

Viton® A fluoroelastomer, a copolymer of vinylidene fluoride and hexafluoropropylene, from Dupont Dow Elastomers CuO (<5 microns, 99+% purity), copper (II) oxide (Cupric), from Aldrich® Chemical, Milwlaukee, Wis.

$Al_2O_3$ (T-64), from Whitaker Clark & Daniels, Inc., South Plainfield, N.J.

SiC (Sika III), from Washington Mills, Niagara Falls, N.Y.

$SnO_2$ (CS3), from Magnesium Electron, Inc., Flemington, N.J.

MgO (Maglite™ -Y), from Merck/Calgon Corp., Teterboro, N.J.

$Fe_2O_3$ (0.7 microns mean particle diameter) from Harcros Pigments Inc., Easton, Pa.

3-aminopropyltriethoxysilane, from Gelest, Inc., Tulleytown, Pa.

Dow™ 1200 RTV Prime Coat primer, from Dow Corning Corporation. A metal alkoxide type primer containing light aliphatic petroleum naptha (85 weight percent), tetra(2-methoxy-ethoxy)-silane (5 weight percent), tetra-propyl orthosilicate (5 weight percent), and tetrabutyl titanate (5 weight percent)

Silastic™-J 60 Shore A addition cure RTV silicone rubber, from Dow Corning Corporation EC4952 65 Shore A condensation cure RTV silicone rubber, from Emerson & Cuming ICI PS513 bis(aminopropyl)terminated polydimethylsiloxane, from United Chemical Technologies, Inc., Bristol, Pa.

Xerox Fusing Agent II aminofunctional polysiloxane blend, from Xerox Corp., Stamford, Conn.

60,000 centistoke DC200 polydimethylsiloxane, from Dow Corning Corporation

Viton® Curative No. 50, from Dupont Dow Elastomers

Catalyst 50, from Emerson & Cuming ICI

Surface Treatment of $Al_2O_3$, $SnO_2$, CuO, and SiC Fillers $Al_2O_3$, $SnO_2$, CuO, and SiC fillers were surface treated in the following manner, prior to their incorporation into fluoroelastomers in the preparation of Fluoroelastomer Compositions 1–8, as discussed below.

In the case of each filler, a solution of 950 ml ethanol, 50 ml HPLC grade water, and 20 grams 3-aminopropyltriethoxysilane was prepared and stirred for 10 minutes. Then the filler, in an amount ranging from 1100 grams to 1250 grams, was added to the solution, stirred, and ultrasonicated for 10 minutes.

Thereafter the filler was separated by vacuum filtration and rinsed w/ethanol. The thusly treated filler was oven dried at 150° C. for 18 hours under a slight vacuum.

Untreated CuO Filler

In accordance with the following discussions concerning preparation of the fluoroelastomer compositions, each of Compositions 1–8 includes untreated CuO as well as a specified surface treated $Al_2O_3$, $SnO_2$, CuO, or SiC filler Preparation of Fluoroelastomer Compositions Composition 1

500 grams of Fluorel™ FE5840Q fluoroelastomer, 15 grams of MgO, 30 grams of Ca(OH)2, 323 grams of the treated $Al_2O_3$, and 250 grams of untreated CuO were thoroughly compounded on a water cooled two roll mill at 63° F. (17° C.) until a uniform, dry composite sheet was obtained. The sheet was removed and stored until used for the preparation of a coating solution.

Compositions 2–8

Compositions 2–8 were prepared in substantially the same manner as Composition 1, except with the fillers listed below in Table 1, treated as discussed and in the indicated amounts, in place of the 323 grams of treated $Al_2O_3$.

TABLE 1

| Composition | Filler | Amount (grams) |
|---|---|---|
| 2 | $Al_2O_3$ | 860 |
| 3 | $SnO_2$ | 566 |
| 4 | $SnO_2$ | 1510 |
| 5 | CuO | 513.5 |
| 6 | CuO | 880.5 |
| 7 | SiC | 265.5 |
| 8 | SiC | 708 |

Composition 9

Composition 9 was prepared using 400 grams of Viton® A fluoroelastomer, 48 grams of MgO, and 664 grams of $Fe_2O_3$, by compounding on a two-roll mill in same manner as employed in the preparation of Composition 1.

Preparation of Fuser Members

The foregoing fluoroelastomer compositions were used to prepare the fuser rollers of Examples 1–8 in the manner as set forth below.

EXAMPLE 1

A cylindrical stainless steel fuser core was cleaned with dichloromethane and dried. The core was then primed with a uniform coat of Dow™ 1200 RTV Prime Coat primer. Silastic™-J silicone rubber was then mixed with catalyst; injection molded onto the core, and cured at 232° C. for 2 hours under 75 tons/inch$^2$ of pressure.

The roller was then removed from the mold and baked in a convection oven with a temperature ramp increasing to 232° C. substantially uniformly over 24 hours, and this temperature then being maintained for an additional 24 hours. After air cooling, EC4952 silicone rubber was blade coated directly onto the Silastic™-J silicone rubber layer, then cured for 12 hours at about 210° C., followed by 48 hours at 218° C. in a convection oven. After air cooling, the EC4952 silicone layer was ground to a thickness of 0.457 mm (0.018 inches), and the thusly layered fuser core was corona discharge treated for 1 minute at 300 watts.

The resulting product was a fuser core with a cushion made up of a Silastic™-J silicone layer having a thickness of 4.572 mm (0.180 inches), overlaid by an EC4952 silicone layer having the thickness as indicated.

To prepare for coating the fluoroelastomer fusing surface layer thereon, the cushion was wiped with isopropyl alcohol. A solution of 225 grams EC4952, 60 grams MEK, and 0.5 grams Catalyst 50 was coated on the cushion surface and allowed to air cure.

A fluoroelastomer solution was prepared by dissolving 94.5 grams of Composition 5 in 150 grams of MEK and 26.3 grams of MeOH, to form a 270 gram solution of Composition 5 at 35 weight percent in an 85:15 MEK:methanol solvent. PS513 was added to the solution at 1 weight percent, to form a solution with a viscosity of 70 cp.

The resulting fluoroelastomer solution was ring-coated onto the corona discharge treated roller twice, with the roller being allowed to dry between coatings. The thusly coated roller was cured at 260° C. for 24 hours, after a 24 hour ramp from room temperature.

After this cure, the roller was pretreated by hand application of an excess of Xerox Fusing Agent II, then placed in an oven at 175° C. for 18 hours. The thickness of the fluoroelastomer coating was measured by removing a small portion of the roller surface and measuring the layer thickness by optical microscopy.

EXAMPLE 2

A fuser roller was prepared in substantially the same manner as that of Example 1, except for the following differences. Specifically, the Silastic™-J cushion layer was molded to a total thickness of 5.08 mm (0.200 inches), the EC4952 layer was omitted, and the roller was not baked in a convection oven. Yet additionally, for the fluoroelastomer layer the ring-coating was conducted with a 250 gram, 32 weight percent solids solution of Composition 1 and an 85:15 MEK:MeOH solvent, at a viscosity of between 90 and 100 cp, with 1 weight percent PS513. The roller was cured, pretreated, and measured as in Example 1.

EXAMPLE 3

A fuser roller was prepared in substantially the same manner as that of Example 1, except for the following differences. Specifically, for the fluoroelastomer layer the ring-coating was conducted with a solution of 135 grams of Composition 4 and an 85:15 MEK:MeOH solvent at 50 weight percent solids, with 1 weight percent PS513 being added prior to coating. The roller was coated, cured, pretreated, and measured as in Example 1.

EXAMPLE 4

A fuser roller was prepared in substantially the same manner as that of Example 2, except for the following differences. Specifically, for the fluoroelastomer layer, two solutions of Composition 8 were used instead of the Composition 1 solution. The first solution was 260 grams of a 39 weight percent solids fluoroelastomer solution, with a viscosity of 47.5 cp. It was coated on twice, with the roller being allowed to dry between coatings. The second solution was a 160 gram solution at 40 weight percent solids, with 1 weight percent PS513 and a viscosity of 53 cp. It was coated on once, thereby providing a total of three fluoroelastomer composition coats. The roller was cured, pretreated, and measured as in Example 1.

EXAMPLE 5

A fuser roller was prepared in substantially the same manner as that of Example 1, except for the following differences. Specifically, for the fluoroelastomer layer, two solutions of Composition 7 were used instead of the Composition 5 solution, and a total of six coats were applied. The first solution was a 260 gram, 31 weight percent solids solution of Composition 7 and an 85:15 MEK:MeOH solvent, with a viscosity of 122.5 cp, and 1 weight percent PS513 being added prior to the coating treatments. It was coated on twice, with the roller being allowed to dry between coatings. The second solution was a 260 gram, 30 weight percent solids solution of Composition 7 and an 85:15 MEK:methanol solvent, with a viscosity of 107 cp, and 1 weight percent PS513 being added prior to the coating treatments. It was coated on four times, with the roller being allowed to dry between coatings. The roller was cured, pretreated, and measured as in Example 1.

EXAMPLE 6

A fuser roller was prepared in substantially the same manner as that of Example 2, except for the following differences. Specifically, for the fluoroelastomer layer, the solution was prepared from Composition 3 instead of Composition 1. This solution was a 270 gram, 37 weight percent solids solution of Composition 3 and an 85:15 MEK:MeOH solvent, with a viscosity of between 90 and 100 cp, and 1 weight percent PS513 being added prior to the coating treatments. It was coated on six times, with the roller being allowed to dry between coatings. The roller was cured, pretreated, and measured as in Example 1.

EXAMPLE 7

A fuser roller was prepared in substantially the same manner as that of Example 2, except for the following differences. Specifically, for the fluoroelastomer layer, two solutions of Composition 6 were used instead of the Composition 1 solution, and a total of five coats were applied. The first solution was a 270 gram, 48 weight percent solids solution of Composition 6 and an 85:15 MEK:MeOH solvent, with a viscosity of 50 cp, and 1 weight percent PS513 being added prior to the coating treatments. It was coated on twice, with the roller being allowed to dry between coatings. The second solution was a 270 gram, 50 weight percent solids solution of Composition 6 and an 85:15 MEK:MeOH solvent, with a viscosity of 70 cp, and 1 weight percent PS513 added prior to the coating treatments. It was coated on three times, with the roller being allowed to dry between coatings. The roller was cured, pretreated, and measured as in Example 1.

EXAMPLE 8

A fuser roller was prepared in substantially the same manner as that of Example 1, except for the following differences. Specifically, for the fluoroelastomer layer, two solutions of Composition 2 were used instead of the Composition 1 solution, and a total of four coats were applied. The first solution was a 322 gram, 46.6 weight percent solids solution of Composition 2 and an 85:15 MEK:MeOH solvent, with a viscosity of 190 cp, and 1 weight percent PS513 being added prior to the coating treatments. It was coated on twice, with the roller being allowed to dry between coats. The second solution was a 314 gram, 44 weight percent solids solution of Composition 2 and an 85:15 MEK:MeOH solvent, with a viscosity of 110 cp, and 1 weight percent PS513 added prior to the coating treatments. This solution also was coated on two times, with the roller being allowed to dry between coatings. The roller was cured, pretreated, and measured as in Example 1.

Particular features of the resulting Examples 1–8 fuser rollers are shown in Table 2.

TABLE 2

| Example | Filler Type | Vol. %† | Fusing Surface Layer Thickness (microns) | Cushion Thermal Conductivity |
|---|---|---|---|---|
| Ex 1 | CuO | 20 | 27.9 | High* |
| Ex 2 | AL2O3 | 20 | 43.2 | Low** |
| Ex 3 | SnO2 | 40 | 50.8 | High |
| Ex 4 | SiC | 40 | 58.4 | Low |
| Ex 5 | SiC | 20 | 150.0 | High |
| Ex 6 | SnO2 | 20 | 165.0 | Low |
| Ex 7 | CuO | 40 | 190.5 | Low |
| Ex 8 | Al2O3 | 40 | 211.0 | High |

†The percent of the compound volume occupied by the filler.
*High cushion thermal conductivity is 0.66 to 0.69 W/m K (measured from the EC4952 cushion layers, of fuser rollers with both Silastic ™-J and EC4952 cushion layers)
**Low underlayer thermal conductivity is 0.31 to 0.346 W/m K (measured from fuser rollers with only Silastic ™-J cushion layers)

The fuser rollers identified in Table 2 were tested in the following manner.

A Heidelberg Digimaster™ 9110 electrophotographic process was used to apply unfused toner to paper substrates. This toner was fixed to the paper by the HD9110 fuser. The fuser rollers of Examples 1–8, were employed in this fuser, with the following changes being made to fuser. Specifically, the release oil was changed from the standard 60,000 centistoke release fluid to Xerox Fuser Agent II. This agent was applied at a rate of 6 milligrams per copy, using a donor roller oiler.

In the Digimaster™ 9110 the fuser roller is heated by contact with two external aluminum heater rollers that are heated by internal lamps. The configuration of these fuser and heater rollers is that as shown in FIG. 1.

Toner offset from the paper is removed from the fuser roller by the heater. rollers, by virtue of the high surface energy of the anodized aluminum surface of the heater rollers. A thin Nomex® web is used to remove toner offset from the heater rollers by contact with both. The density of the toner offset collected by the cleaning web estimates the offset rate of the fuser. As discussed herein, this offset acts as contamination, and accordingly offset rate indicates the degree of contamination. Therefore, the density of this offset on the web is a measure of the degree of contamination.

In order to measure fuser offset collected on the fuser heater roller cleaning web, each of the Examples 1–8 fuser rollers was run for 5,000 prints of a multiple density image. An X-Rite 310 Transmission Densitometer, from X-Rite Company, Grand Rapids, Mich. was used to measure the optical transmission density of the offset on the heater roller cleaning web.

The values obtained from these tests are set forth in Table 3. A higher web transmission density indicates an increased fuser offset rate, and thusly a greater degree of contamination. As discussed herein, poor contamination leads to offset on electrostatographic apparatus parts and also on images, and yet additionally reduces roller life.

Clean webs were used to set the measure optical transmission density to zero. With respect to contamination,. cleaning web transmission densities below 0.3 are excellent, at 0.31 to 0.5 are good, at 0.51 to 0.79 are marginal, and at 0.8 and above are unacceptable.

Print samples were taken from a shorter run of maximum density images to measure fusing quality for each of the Example 1–8 fuser rollers. Fusing quality was measured in terms of Actual Crack Width (ACW), which is the average width of removed toner, as a result of folding a print so that the crease passes through a maximum density image, and removing the toner residue from the crease in a consistent manner.

The results of these fusing quality tests are also set forth in Table 3. ACW is measured in microns. As toner is better fused, ACW decreases. An ACW below 50 is excellent, at 50–75 is good, and at 76–150 is marginally acceptable.

Unless otherwise noted a above, all materials, hardware and set points used to compare the indicated fuser rollers were consistent with the Heidelberg Digimaster™ 9110.

TABLE 3

| | Layer Thickness (microns) | ACW (microns) | Transmission Density |
|---|---|---|---|
| Ex 1 | 27.9 | 82 | 0.26 |
| Ex 2 | 43.2 | 52 | 0.36 |
| Ex 3 | 50.8 | 45 | 0.35 |
| Ex 4 | 58.4 | 58 | 0.43 |

TABLE 3-continued

| | Layer Thickness (microns) | ACW (microns) | Transmission Density |
|---|---|---|---|
| Ex 5 | 150.0 | 70 | 0.79 |
| Ex 6 | 165.0 | 90 | 0.64 |
| Ex 7 | 190.5 | 68 | 0.85 |
| Ex 8 | 211.0 | 110 | 0.92 |

The transmission density values provided in Table 3 demonstrate that the thickness of the fusing surface layer is critical to the generation of low contamination. The fuser rollers of Examples 7 and 8, having fusing surface layer thicknesses of 190.5 microns and 211.0 microns, respectively, are shown to be unacceptable in this regard.

Further, the values listed in Table 2, considered together with those of Table 3, show another unexpected result with respect to contamination. Specifically, these measurements indicate that little or no impact on resistance to contamination arises from the proportion by volume of heat conducting filler in the fusing surface layer, or from identity of this filler, or from its thermal conductivity, or from the thermal conductivity of the cushion. It can accordingly be seen that the single most significant factor affecting contamination is fusing surface layer thickness, with all of the other measured factors being insignificant.

The Example 1 roller, as shown in Table 3, was found to give excellent results as to contamination. However, fusing quality and contamination resistance are not the only important properties for a toner fusing system. The system's roller also must be able to survive many hundreds of thousands of copies, preferably at least 800,000 to 900,000.

The tests resulting in the values set forth in Table 3 were very short, and not useful for determining roller life. Examples 9–12 were accordingly prepared for the purpose of evaluating this property.

EXAMPLE 9

A fuser core was provided with a Silastic™-J cushion thickness of 5.08 mm (0.200 inches). A solution of 225 gram EC4952, 60 gram MEK, and 0.5 gram Catalyst 50 was coated on the roller surface and allowed to air cure.

A fluoroelastomer solution was prepared by dissolving 100 gram of Composition 9 in 147 gram of MEK. PS513 was added to the solution at 1 weight percent, along with 2.2 grams of Viton® Curative No. 50.

The roller cushion was corona discharge treated, and then the fluoroelastomer solution was ring-coated onto the roller three times, with the roller being allowed to dry between coatings. The roll was cured at 230° C. for 24 hours after a 12 hour ramp from room temperature. The thickness of the resulting fluoroelastomer composition coating was measured to be 81.3 microns (0.0032 inches).

EXAMPLES 10–12

Three rollers were prepared in substantially the same manner as that of Example 9, except in each instance the fluoroelastomer solution was prepared from 85 grams of Composition 9 and 120 grams of MEK, and the roller was coated only once prior to curing. The measured fluoroelastomer composition coating thickness was 23 microns, 23.6 microns, and 25 microns for the rollers of Examples 10, 11, and 12, respectively.

Another set of tests were conducted, also using a Heidelberg Digimaster™ 9110 electrophotographic process and fuser, with the following changes being made to the fuser. Here also the release oil was changed from the standard 60,000 cSt release fluid to a blend of 87.5 weight percent DC200 and 12.5 weight percent of an α-aminopropyl, ω-trimethyl terminated polydimethylsiloxane with a number average molecular weight of 12,000.

The oil was applied using a standard wick oiler.

The roller of Example 9 was run in a life test, to an amount in excess of 970,000 copies. The roller did not wear through at the edges or show signs of delamination.

The Example 10 roller was run in a life test out to 300,000 copies. This roller showed delamination of the fluoroelastomer composition coating at the paper edge, and in the paper path of the roller.

The roller of Example 11 also showed significant delamination wear at the paper edge after several tens of thousands of copies. The Example 12 roller exhibited delamination failure and was pulled before significant life could be accumulated. For both of Examples 11 and 12, the runs were far shorter than the 300,000 copies of Example 11.

While the cushions, the fluoroelastomer composition, and corona treatments were the same for all of the Examples 9–12 rollers, the rollers of Examples 10–12, characterized by thin fusing surface layers (less than 30 microns), failed very early and therefore were unacceptable. Correspondingly, though the Example 1 roller was found to have excellent contamination resistance, as shown in Table 3, it also could be expected to provide unacceptable results from a life test, by virtue of its also having a relatively thin (27.9 microns) fusing surface layer.

In contrast, the thicker 81 micron coating of the Example 9 roller was shown to have both delamination and wear resistance. However, as evidenced by the density values in Table 3, fluoroelastomer coatings that are too thick (greater than 180 microns) produce unacceptable contamination.

From the foregoing tests, it can be seen that there is a small range of fluoroelastomer fusing surface layer thickness that provides both good contamination resistance and acceptable wear properties in a fusing system where the primary source of heat for the roller surface layer is external.

Finally, although the invention has been described with reference to particular means, materials, and embodiments, it should be noted that the invention is not limited to the particulars disclosed, and extends to all equivalents within the scope of the claims.

What is claimed is:

1. A toner fusing system comprising:

(a) a fuser member, for contacting and heating toner residing on a substrate to fuse the toner to the substrate, the fuser member comprising:

(1) a fuser base;

(2) a fusing surface layer comprising at least one fluoroelastomer, and having a thickness of from 38 microns to 178 microns; and (3) at least one cushion layer interposed between the fuser base and the fusing surface layer, and comprising one or more cushion layers each having a Shore A durometer of about 75 or less, with the total thickness, of the one or more cushion layers each having a Shore A durometer of about 75 or less, being at least about 3.3 millimeters; and (b) at least one external heating member for heating the fusing surface layer, the at least one external heating member comprising at least one contact heating member, and providing more than 50 percent of the heat energy for fusing the toner to the substrate.

2. The toner fusing system of claim 1, wherein the at least one cushion layer comprises at least one silicone elastomer layer.

3. The toner fusing system of claim 1, wherein the fusing surface layer has a thickness of from 50 microns to 130 microns.

4. The toner fusing system of claim 3, wherein the fusing surface layer further comprises up to about 45 percent by volume heat conducting filler particles.

5. The toner fusing system of claim 4, wherein the heat conducting filler particles are coupling agent treated.

6. The toner fusing system of claim 1, wherein the fuser base comprises a cylindrical roller.

7. The toner fusing system of claim 6, further comprising at least one internal heating member for heating the fusing surface layer, the at least one internal heating member providing less than 50 percent of the heat energy for fusing the toner to the substrate.

8. The toner fusing system of claim 6, wherein the at least one contact heating member comprises a cylindrical roller with a heat energy generator disposed therein.

9. The toner fusing system of claim 8, wherein the at least one cushion layer comprises one or more cushion layers each having a Shore A durometer about 70 or less, with the total thickness, of the one or more cushion layers each having a Shore A durometer of about 70 or less, being from about 3.8 millimeters to about 13 millimeters.

10. The toner fusing system of claim 8, wherein the at least one cushion layer comprises one or more cushion layers each having a Shore A durometer of from about 20 to about 75, with the total thickness, of the one or more cushion layers each having a Shore A durometer of from about 20 to about 75, being from about 5 millimeters to about 10 millimeters.

11. The toner fusing system of claim 8, wherein the at least one contact heating member comprises two contact heating members spaced apart, each of the, two contact heating members comprising a cylindrical roller with a heat energy generator disposed therein, with the fuser member situated between the two contact heating members.

12. The toner fusing system of claim 11, wherein the at least one cushion layer consists essentially of one thermally nonconductive silicone elastomer layer.

13. The toner fusing system of claim 12, wherein the fluoroelastomer layer has a thickness of from 50 microns to 130 microns and comprises from about 20 to about 40 percent by volume heat conducting filler particles, and wherein the thermally nonconductive silicone elastomer layer has a Shore A durometer of from about 20 to about 75 and a thickness of from about 5 millimeters to about 10 millimeters.

14. The toner fusing system of claim 11, wherein the at least one cushion layer comprises one thermally nonconductive silicone elastomer layer and at least one thermally conductive silicone elastomer layer.

15. The toner fusing system of claim 14, wherein the fluoroelastomer layer has a thickness of from 50 microns to 130 microns and comprises from about 20 to about 40 percent by volume heat conducting filler particles, and wherein the one thermally nonconductive silicone elastomer layer and the at least one thermally conductive silicone elastomer layer have a total thickness of from about 5 millimeters to about 10 millimeters.

16. The toner fusing system of claim 1, wherein the fusing surface layer further comprises the product obtained from subjecting at least one α,ω difunctional polydiorganosiloxane to curing.

17. The toner fusing system of claim 1, wherein the fusing surface layer further comprises at least one cured siloxane polymer.

18. A process for fusing toner residing on a substrate to the substrate, the process comprising:

(a) heating a fuser member by at least one external heating member, the fuser member comprising:
  (1) a fuser base;
  (2) a fusing surface layer comprising at least one fluoroelastomer, and having a thickness of from 38 microns to 178 microns; and
  (3) at least one cushion layer interposed between the fuser base and the fusing surface layer, and comprising one or more cushion layers each having a Shore A durometer of about 75 or less, with the total thickness, of the one or more cushion layers each having a Shore A durometer of about 75 or less, being at least about 3.3 millimeters; and (b) contacting the toner with the heated fuser member to heat the toner and to fuse the toner to the substrate;

wherein the at least one external heating member comprises at least one contact heating member, and provides more than 50 percent of the heat energy for fusing the toner to the substrate.

19. The process of claim 17, wherein the fuser base comprises a cylindrical roller, and wherein the at least one contact heating member comprises a cylindrical roller with a heat energy generator disposed therein.

20. The process of claim 19, wherein the at least one contact heating member comprises two contact heating members spaced apart, each of the two contact heating members comprising a cylindrical roller with a heat energy generator disposed therein, with the fuser member situated between the two contact heating members.

21. The process of claim 20, wherein the fluoroelastomer layer has a thickness of from 50 microns to 130 microns and comprises from about 20 to about 40 percent by volume heat conducting filler particles, and wherein the at least one cushion layer consists essentially of one thermally nonconductive silicone elastomer layer, having a Shore A durometer of from about 20 to about 75 and a thickness of from about 5 millimeters to about 10 millimeters.

22. The process of claim 21, further comprising, before contacting the toner with the heated fuser member, applying a release agent composition to the fusing surface layer, the release agent composition comprising a blend of a nonfunctional polyorganosiloxane and an amino functional polyorganosiloxane, the amino functional polyorganosiloxane comprising monoamino functional polyorganosiloxane.

23. The process of claim 21, further comprising, before contacting the toner with the heated fuser member, applying a release agent composition to the fusing surface layer, the release agent composition comprising a blend of a nonfunctional polyorganosiloxane and a mercapto functional polyorganosiloxane, the mercapto functional polyorganosiloxane comprising monomercapto functional polyorganosiloxane.

24. The process of claim 20, wherein the fluoroelastomer layer has a thickness of from 50 microns to 130 microns and comprises from about 20 to about 40 percent by volume heat conducting filler particles, and wherein the at least one cushion layer comprises one thermally nonconductive silicone elastomer layer and at least one thermally conductive silicone elastomer layer, having a total thickness of from about 5 millimeters to about 10 millimeters.

25. The process of claim 24, further comprising, before contacting the toner with the heated fuser member, applying a release agent composition to the fusing surface layer, the release agent composition comprising a blend of a nonfunctional polyorganosiloxane and an amino functional polyorganosiloxane, the amino functional polyorganosiloxane comprising monoamino functional polyorganosiloxane.

26. The process of claim 24, further comprising, before contacting the toner with the heated fuser member, applying a release agent composition to the fusing surface layer, the release agent composition comprising a blend of a nonfunctional polyorganosiloxane and a mercapto functional polyorganosiloxane, the mercapto functional polyorganosiloxane comprising monomercapto functional polyorganosiloxane.

* * * * *